US006529812B1

(12) United States Patent
Koehrsen et al.

(10) Patent No.: US 6,529,812 B1
(45) Date of Patent: Mar. 4, 2003

(54) METHOD AND SYSTEM FOR EFFICIENT PROCESSOR USAGE

(75) Inventors: Craig Lawrence Koehrsen, East Peoria, IL (US); Eric Alan Moughler, Metamora, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/939,676

(22) Filed: Aug. 28, 2001

(51) Int. Cl.[7] ..... G06F 7/70; G06G 7/76

(52) U.S. Cl. ..... 701/50; 701/213; 701/300; 701/207; 342/357; 342/457; 700/66; 700/83

(58) Field of Search ..... 701/50, 49, 213, 701/300, 207, 36, 35, 208; 342/357, 457; 340/990; 700/60, 83, 59

(56) References Cited

U.S. PATENT DOCUMENTS 5,586,030 A * 12/1996 Kemner et al. ..... 340/909
5,646,844 A * 7/1997 Gudat et al. ..... 701/208
5,742,914 A 4/1998 Hagenbuch ..... 701/35
5,848,368 A * 12/1998 Allen et al. ..... 701/50
5,850,341 A * 12/1998 Fournier et al. ..... 342/147
5,880,958 A 3/1999 Helms et al. ..... 340/993
5,906,646 A 5/1999 Kemner ..... 701/23
5,913,914 A 6/1999 Kemner et al. ..... 701/50
5,925,085 A * 7/1999 Kleimenhagen et al. ..... 701/50
5,931,875 A 8/1999 Kemner et al. ..... 701/23
5,935,192 A * 8/1999 Henderson et al. ..... 701/208
5,961,560 A 10/1999 Kemner ..... 701/24
6,044,312 A * 3/2000 Sudo et al. ..... 701/25
6,047,227 A * 4/2000 Henderson et al. ..... 701/50
6,141,614 A * 10/2000 Janzen et al. ..... 701/50
6,246,932 B1 6/2001 Kageyama et al. ..... 701/24

* cited by examiner

*Primary Examiner*—William A. Cuchlinski, Jr.
*Assistant Examiner*—Tuan To
(74) *Attorney, Agent, or Firm*—Finnegan, Henderson, Farabow, Garrett & Dunner

(57) ABSTRACT

A method is provided for providing a work machine with information about a processing machine. Information about a processing machine is determined. The determined information is sent to the work machine. The work machine then communicates the determined information to a controller of the work machine.

18 Claims, 3 Drawing Sheets

METHOD AND SYSTEM FOR EFFICIENT PROCESSOR USAGE

TECHNICAL FIELD

The present invention relates generally to systems where loads are delivered to processing machines, and more particularly, to a method and system to increase the efficiency of such a system by providing information about the processing machines to the vehicle delivering the loads.

BACKGROUND

In a number of industries, vehicles or other transportation methods are used to deliver loads to processing machines. In particular, in the mining industry, trucks are used to deliver mined ore to a crusher machine for processing. Upon receiving a load of ore, the truck will proceed to a processing site at the mine. At the processing site, the truck will proceed to one of the crusher machines and unload the mined ore. The crusher machine will then crush the ore to a fine powder from which the desired mineral can be extracted.

At each processing site, there are typically at least two crusher machines. For example, there may be one on each side of the mine road at a given processing site. The operator of the trucks delivering ore to the crusher can access either of the crushers at a given processing site. Because a number of trucks move through the processing site each day, the crusher machines may be completing processing on a previously delivered load of ore and the truck operator may need to wait until there is sufficient capacity in the crusher to unload his delivery. This causes inefficiency, as the vehicle must remain idle, rather than returning to the mining site to pick up additional ore. Alternatively, if a crusher machine is allowed to be empty, the crusher is stalled and productivity is decreased.

To maximize productivity and efficiency, a truck operator needs to have information about the processing capabilities and the current capacity of the crusher machines at the given processing site. Currently, systems exist that improve efficiency by allocating processing site resources, such as crushing machines. For example, in U.S. Pat. No. 5,906,646, entitled "System and Method for Managing Access to a Resource Shared by a Plurality of Mobile Machines," the processing site is managed by creating a queue system. As a vehicle approaches a processing site, it requests a position in the queue. A resource management system determines a queue position and replies to the requesting vehicle. This system, however, does not provide information about the capabilities or capacity of the processing site.

The present invention is directed to overcoming one or more of the problems or disadvantages associated with the prior art.

SUMMARY OF THE INVENTION

A method is provided for providing a work machine with information about a processing machine. Information about a processing machine is determined. The determined information is sent to the work machine.

The work machine then communicates the determined information to the controller of the work machine.

Further, a system is provided for providing information to a work machine, where the work machine includes a load to be delivered to a processing machine. The system includes at least one processing machine, wherein the processing machine includes a monitoring system for determining information about the processing machine. Further, the system includes a communication system configured to request and receive the determined information from the processing machine and to communicate the information.

Finally, a method is provided for increasing efficiency in a system including a work machine and a plurality of processing machines, wherein the work machine delivers a load to one of the plurality of processing machines. First, a set of processing machines nearest to the work machine is determined. Information about the set of processing machines is requested. The requested information is displayed and the load is delivered to one of the set of processing machines based on the displayed information.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION

Reference will now be made in detail to embodiments of the invention, examples of which are illustrated in the accompanying drawings. Wherever possible, the same reference numbers will be used throughout the drawings to refer to the same or like parts.

In accordance with the present invention, a system and method are provided to increase efficiency by maximizing the capabilities of processor machines, such as crushers, and by minimizing idle time of vehicles. For example, after receiving a load of ore, a vehicle operator may proceed down a mine road to one of a plurality of processing site. At each processing site, there may be a set of processing machines, for example, two crusher machines—one off the right side of the road and one off the left side of the road. As the vehicle approaches the processing site, the vehicle operator accesses the system to obtain information about each of the crusher machines at the processing site. For example, the system may indicate the capacities of each crusher machine, as well as the current level of ore in each crusher machine. The vehicle operator may then choose or be directed to the crusher machine that is best able to handle the load of ore in the vehicle. Alternatively, the vehicle may be controlled by a remote control or an electronic control module (ECM). In this embodiment, the system may indicate information about the processing machines to the controller and may direct the vehicle controller to a particular processing machine. An operator may be an non-automated version of a controller.

Figure 1:
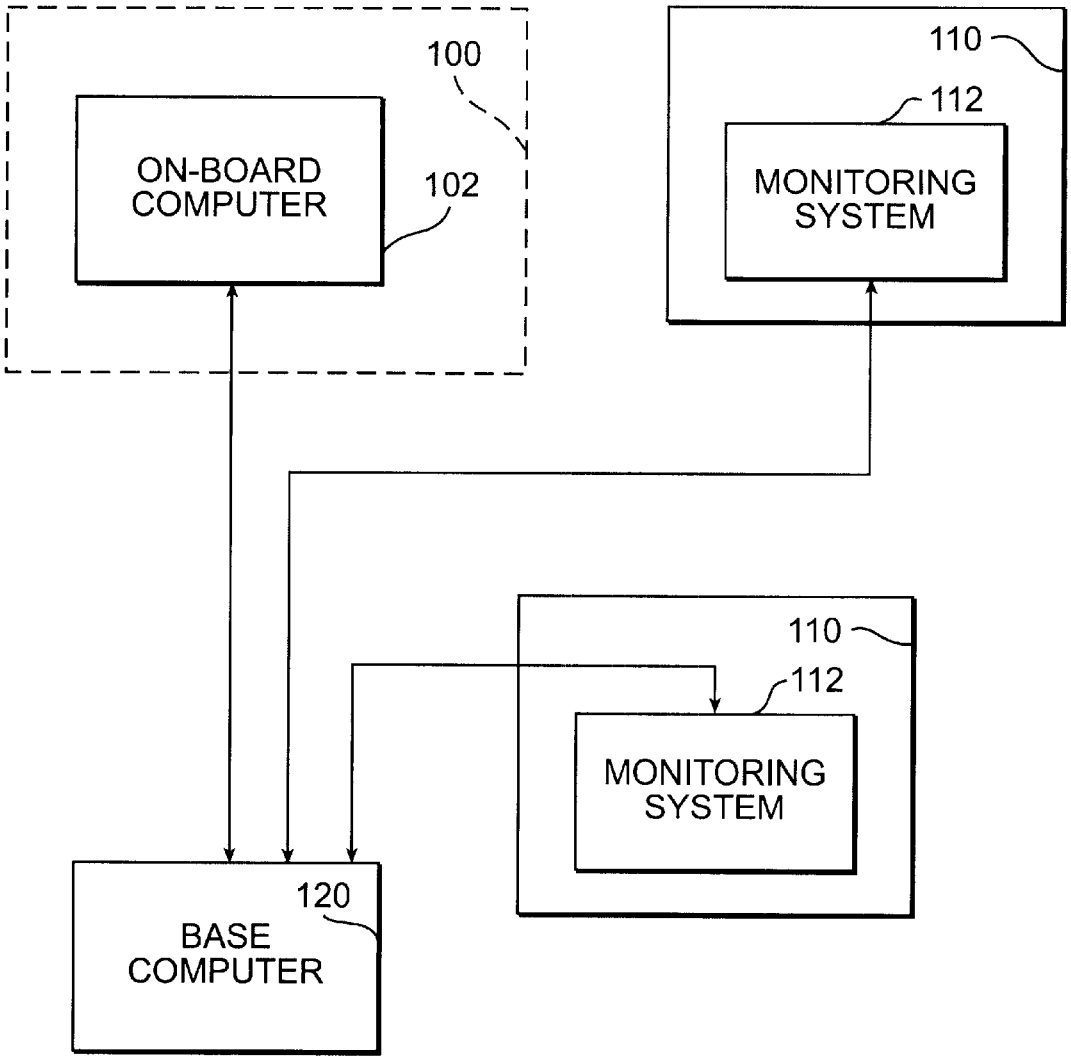
FIG. 1 is a block diagram of an exemplary capacity information system.

FIG. 1 illustrates a system consistent with the present invention. As shown in FIG. 1, the system includes a work machine or vehicle 100, a plurality of processing machines 110, and a base computer 120. Vehicle 100 transports ore or other loads to processing machines 110. Vehicle 100 includes an on-board computer 102. On-board computer 102 may include a display element, to provide information to the vehicle operator. Information may alternatively be conveyed to the vehicle operator through other means, such as an audio message. Further, on-board computer 102 may include interactive elements, such as a keypad, to receive information from the vehicle operator. On-board computer 102 may also be equipped with a position sensing system and wireless communication capabilities. The position sensing system may include a Global Positioning System (GPS), a laser positioning system, an inertial navigation unit, or any suitable system or combination thereof.

Processing machines 110 receive ore or other loads from vehicle 100 for processing. For example, processing machines 110 may include crusher machines. Processing machines 110 each include a monitoring system 112. Monitoring system 112 monitors information about the processing machine, such as current level of ore in the machine for processing. Monitoring system 112 may also include static information, such as total capacity or processing rate of the machine. Monitoring system 112 may also include wireless communication capabilities. Although FIG. 1 illustrates two processing machines 110, it should be understood that a system consistent with the present invention may include additional processing machines.

Vehicle 100 interacts with processing machines 110 via base computer 120. For example, the operator of vehicle 100 may press a button on on-board computer 102 indicating that the vehicle is seeking processing site information. In an alternative embodiment, on-board computer 102 may initiate the information request at a predetermined time, such as when the vehicle has been fully loaded or when the vehicle is within a defined distance from a processing site. On-board computer 102, using the position sensing system information, determines the processing site nearest to the vehicle. (Alternatively, on-board computer 102 may use position sensing system information to determine its own location and send that information to base computer 120, which determines the location of the nearest processing site.) On-board computer 102 then sends a message, via wireless communication, to base computer 120. The message may include a request for information about the nearest processing site. Base computer 120 then sends a request to the monitoring system 112 of each processing machine 110 located in the nearest processing site. Each monitoring system 112 determines the requested information and replies to the base computer 120. Base computer 120 may then format the information for display and forward the formatted information to on-board computer 102. On-board computer 102 then displays the information graphically via the display element.

On-board computer 102 and/or base computer 120 may be implemented in various environments to provide the tools for obtaining the required data and providing the data to the operator. On-board computer 102 and/or base computer 120 may be hardware specifically constructed for performing various processes and operations of the invention or may include a general purpose computer or computing platform selectively activated or reconfigured by program code to provide the necessary functionality. Base computer 120 may exist at a location separate from vehicle 100, such as at a central office location. Alternatively, on-board computer 102 may include base computer 120. In this embodiment, the on-board computer 102 may interact directly with processing machines 110. In yet another embodiment, base computer 120 may be located at the processing machines 110. The on-board computer 102 and the base computer 120, combined, may be considered the communication system, regardless of the location of the on-board computer 102 and the base computer 120. The communication system is configured to request and receive information from the processing machines 110 and to communicate that information.

Figure 2:
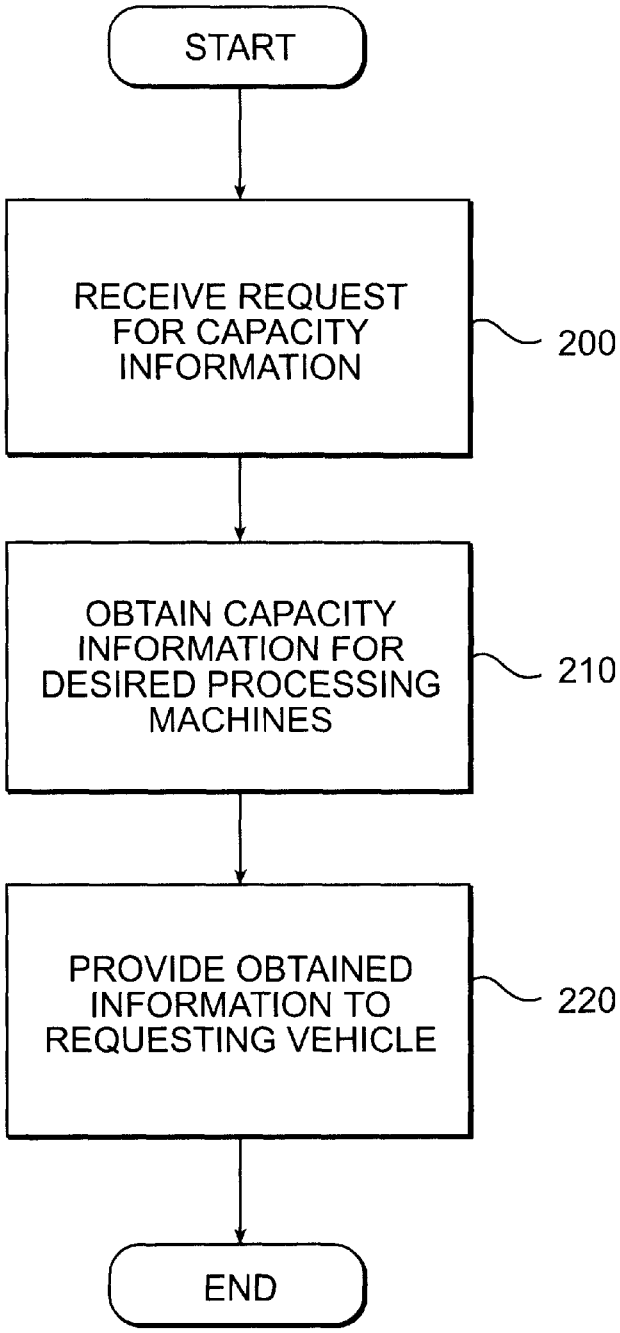
FIG. 2 is an exemplary flow chart of a method for increasing efficiency by providing capacity information, consistent with one embodiment of the present invention.

FIG. 2 illustrates an exemplary flow chart of a method for increasing efficiency of processing machine usage, as performed by base computer 120, consistent with an embodiment of the present invention. First, base computer 120 receives a request for capacity information from vehicle 100 (step 200). The request may include the locations of the processing machines 110 nearest to vehicle 100, or alternatively, may include the location of vehicle 100. In this embodiment, base computer 120 would then determine the locations of the processing machines nearest to vehicle 100. Location information may be determined using the position sensing system.

Next, capacity information for the processing machines 110 nearest to vehicle 100 is obtained (step 210). Specifically, base computer 120 sends a request for information to a monitoring system 112 located at each of the processing machines 110 nearest to vehicle 100. Base computer 120 may send these requests for information via wireless technology, or may be linked to processing machines via other networks, such as local area network LAN, cable modem, ISDN line, or telephone line. Each monitoring system 112 replies with information about the processing machine's current level of, for example, ore. Monitoring system 112 may also reply with additional information, such as the capacity of the processing machine 110.

Finally, the obtained information is provided to the requesting vehicle 100 (step 220). Base computer 120 may format the capacity information prior to sending it to the vehicle 100. Alternatively, formatting may be done by on-board computer 102. On-board computer 102 then displays the information to the vehicle operator, via a display element such as a monitor or LCD panel. Further detail about the display of information is discussed with reference to FIGS. 3A and 3B.

Figure 3A:
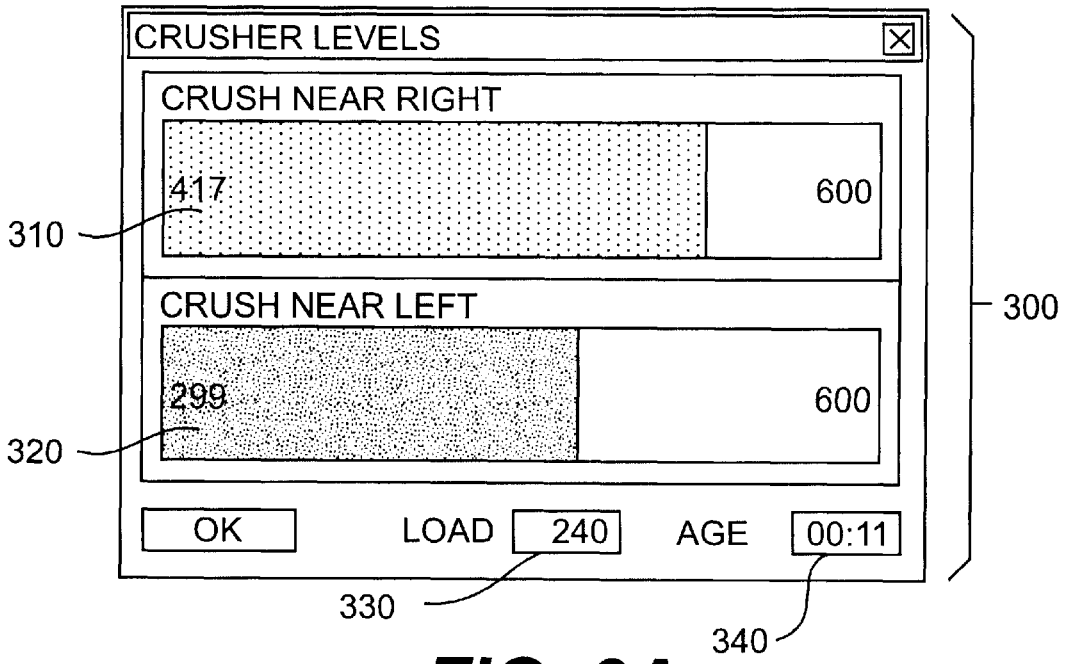
FIG. 3A is an exemplary interface for viewing capacity information, consistent with one embodiment of the present invention.
Figure 3B:
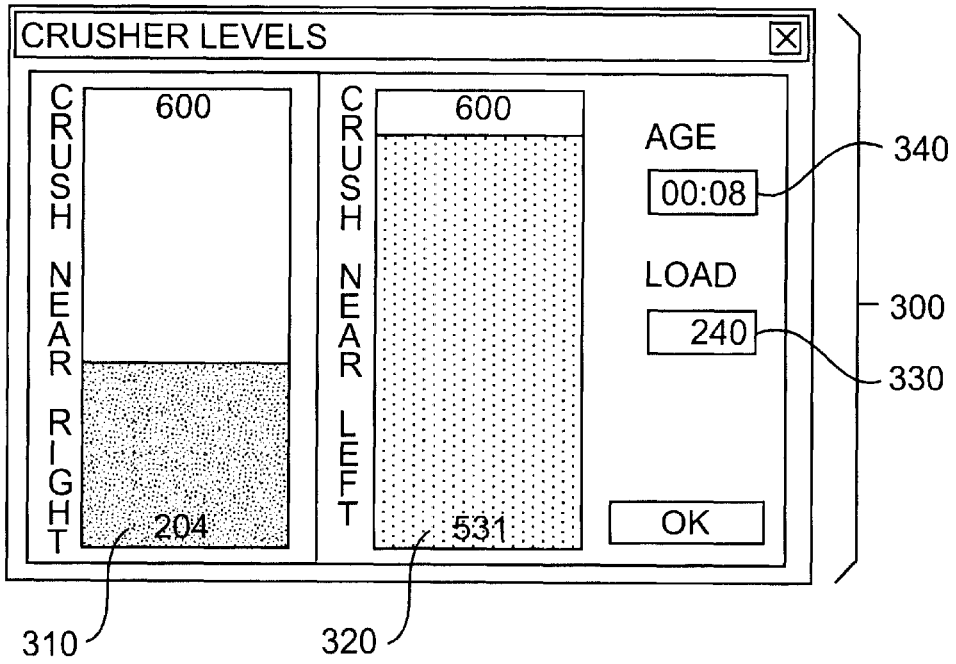
FIG. 3B is an exemplary interface for viewing capacity information, consistent with one embodiment of the present invention.

FIG. 3A illustrates an exemplary interface 300 for displaying the capacity information to the vehicle operator. Interface 300 includes information about the level of ore in the crusher machine nearest vehicle 100 on the right 310, as well as information about the level of ore in the nearest crusher machine on the left 320. Additionally, interface 300 may include other information, such as the load 330 of ore currently on vehicle 100. The load information may be based on current payload information, which is often measured by a payload system on vehicle 100. Alternatively, the load information may be an estimate based on the rated capacity of the vehicle. Further, interface 300 may include the age of the information 340. This information may be important, as the crusher machine is constantly processing its current level of ore. Thus, information that is too old is inaccurate. Although information about two crushing machines is illustrated, it should be understood that interface 300 may be configured to display information about a plurality of crushers. FIG. 3B illustrates an exemplary interface 300, similar to FIG. 3A, but in a vertical orientation.

In addition to the above-described information, a number of other options are available to make interface 300 more useful. In one embodiment, information about the processing rate of the crusher machine is sent with the current level information. In this embodiment, it is possible for either base computer 120 or on-board computer 102 to estimate the current crusher level, even if the information ages. This embodiment assumes a linear flow rate, as well as the fact that no other trucks have intervened at the crushing machine. In concurrence with this embodiment, the on-board computer 102 may also be configured with an automatic refresh, wherein the on-board computer 102, using an updated estimate based on crusher rate, refreshes the display at regular time intervals. To obtain an actual current level at the crusher machines, the vehicle operator would press a button on the on-board computer, thus beginning the method to obtain actual data from the crusher machines.

Alternatively, interface 300 may use color or other indicator to provide additional information. For example, if the crusher on the nearest right has sufficient capacity to handle the load of the vehicle, it may be displayed in one color. If the crusher on the nearest left, however, would require the vehicle operator to wait prior to delivering the load, the display of the crusher on the near left may be displayed in a second color. If a crusher is nearly empty, the display might be in yet another color. Finally, an alternate color may be used to indicate that the information is too old to be reliable.

INDUSTRIAL APPLICABILITY

Systems and methods consistent with the present invention provide a way to increase the efficiency of processor usage, thereby maximizing productivity of both the vehicles and the processing machines. By providing a vehicle operator with capacity and level information about the nearest processing machines, the vehicle operator can make an informed decision in choosing which machine to approach to unload his delivery. In this way, the vehicle operator can choose a processing machine that will be able to promptly accept his load, and the vehicle can then return to pick up an additional load for processing, rather than causing the vehicle to be idle while awaiting a processing machine that will be able to accept the load. Further, the system provides a way to avoid stalling the crusher machines, by alerting the vehicle operators (as well as the base computer, potentially) of low levels, for example, below a threshold level, in a particular crushing machine.

The system and method of the present invention may be expanded to include not only the nearest processing site, but the next-nearest processing site, thereby providing information permitting the vehicle operator to bypass a processing site where all of the processing machines are too full to permit the operator to deliver the load, in favor of the next-nearest processing site, where there are potentially nearly empty processing machines.

The system and method of the present invention may also be used for processing machines other than crusher machines. Specifically, this system and method are consistent with any situation where a vehicle (or other transportation method) is used to transport a load to one of a plurality of processing machines, where the processing machines do not have an infinite capacity. Thus, the present invention has a wide application to increase efficiency by providing vehicle operators with information about processing machines, thus maximizing the use of the vehicle and minimizing the chance of stalling the processing machine.

It will be readily apparent to those skilled in this art that various changes and modifications of an obvious nature may be made, and all such changes and modifications are considered to fall within the scope of the appended claims. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A method for providing a work machine with information about a processing machine, the method comprising:

selecting at least one processing machine from a plurality of processing machines;

determining information about the selected processing machine;

sending the determined information to the work machine; and communicating the determined information to a controller of the work machine.

2. The method of claim 1, wherein the step of selecting at least one processing machine includes:

determining a set of processing machines nearest to the work machine.

3. The method of claim 2, wherein the step of determining a set of processing machines includes:

using a position sensing system to obtain the location of at least one processing machine nearest to the work machine.

4. The method of claim 1, wherein the step of determining information includes:

determining information about each of the selected processing machines.

5. The method of claim 1, wherein the step of communicating the determined information includes:

displaying the determined information in a graphical format.

6. The method of claim 5, further including:

providing additional information by varying the graphical format in which the determined information is displayed.

7. The method of claim 6, wherein the addition information is provided by displaying the determined information in colors, wherein each color indicates an additional piece of information.

8. The method of claim 1, wherein the step of communicating the determined information includes:

displaying at least one of the following: a current level for the processing machine, a capacity level for the processing machine, a load level for the work machine, age information for the determined information, or the processing rate for the processing machine.

9. The method of claim 1, wherein the controller of the work machine initiates the step of determining information about the processing machine.

10. The method of claim 1, further including:

updating the communicated information at regular intervals.

11. A system for providing information to a work machine, where the work machine includes a load to be delivered to a processing machine, the system comprising:

a plurality of processing machines, wherein each processing machine includes a monitoring system for determining information about the particular processing machine; and a communication system configured to request and receive the determined information from at least one of the plurality of processing machines and to communicate the information, wherein the communication system includes a base computer for selecting at least one processing machine from the plurality of processing machines and for requesting and receiving the determined information from one or more of the plurality of processing machines and an on-board computer of the work machine for communicating the information.

12. The system of claim 11, wherein the on-board computer and the base computer are connected via a wireless communication system.

13. The system of claim 11, wherein the on-board computer includes a position sensing system.

14. The system of claim 11, wherein the processing machine is a crusher machine.

15. A method of increasing efficiency in a system including a work machine and a plurality of processing machines, wherein the work machine delivers a load to one of the plurality of processing machines, the method comprising:

determining a set of processing machines nearest to the work machine;

requesting information about the set of processing machines;

displaying the requested information about the set of processing machines; and delivering the load to one of the set of processing machines based on the displayed information.

16. The method of claim 15, wherein the requested information includes a level and a capacity for each processing machine in the set.

17. The method of claim 16, wherein the step of delivering the load to one of the set of processing machines includes:

determining a processing machine in the set of processing machines wherein the capacity of the processing machine minus the level of the processing machine is greater than the load to be delivered.

18. The method of claim 16, wherein the step of delivering the load to one of the set of processing machines includes:

determining a processing machine in the set of processing machines wherein the level of the processing machines is less than a threshold value.

* * * * *